US011145984B2

(12) United States Patent
Murphy

(10) Patent No.: US 11,145,984 B2
(45) Date of Patent: Oct. 12, 2021

(54) LOW-PROFILE FOLDED METAL ANTENNA

(71) Applicant: Thomson Licensing, Cesson-Sevigne (FR)

(72) Inventor: William T. Murphy, Lawrenceville, GA (US)

(73) Assignee: Thomson Licensing, Cesson-Sevigne (FR)

( * ) Notice: Subject to any disclaimer, the term of this patent is extended or adjusted under 35 U.S.C. 154(b) by 14 days.

(21) Appl. No.: 16/621,718

(22) PCT Filed: Jun. 20, 2018

(86) PCT No.: PCT/US2018/038489
§ 371 (c)(1),
(2) Date: Dec. 12, 2019

(87) PCT Pub. No.: WO2018/236994
PCT Pub. Date: Dec. 27, 2018

(65) Prior Publication Data

US 2020/0203840 A1 Jun. 25, 2020

Related U.S. Application Data

(60) Provisional application No. 62/522,760, filed on Jun. 21, 2017.

(51) Int. Cl.

| | |
|---|---|
| ***H01Q 5/48*** | (2015.01) |
| ***H01Q 9/28*** | (2006.01) |
| ***H01Q 9/26*** | (2006.01) |
| ***H01Q 21/28*** | (2006.01) |

(52) U.S. Cl.
CPC ..... *H01Q 9/285* (2013.01); *H01Q 5/48* (2015.01); *H01Q 9/26* (2013.01); *H01Q 21/28* (2013.01)

(58) Field of Classification Search
CPC ..... H01G 9/285; H01G 5/48; H01G 9/26; H01G 21/28
See application file for complete search history.

(56) References Cited

U.S. PATENT DOCUMENTS

| | | | | |
|---|---|---|---|---|
| 2007/0018901 | A1* | 1/2007 | Wang | H01Q 11/105 343/792.5 |
| 2012/0268339 | A1 | 10/2012 | Qi et al. | |
| 2015/0042530 | A1 | 2/2015 | Kitano et al. | |

FOREIGN PATENT DOCUMENTS

| | | | |
|---|---|---|---|
| CN | 101895014 | A | 11/2010 |
| CN | 102522628 | A | 6/2012 |
| CN | 10305778 | A | 4/2013 |
| CN | 103579745 | A | 2/2014 |
| EP | 1229605 | A1 | 8/2002 |
| JP | 2006074537 | A | 3/2006 |
| WO | 2015133458 | A1 | 9/2015 |
| WO | 2017180470 | A1 | 10/2017 |

* cited by examiner

*Primary Examiner* — Graham P Smith
(74) *Attorney, Agent, or Firm* — Vincent Edward Duffy

(57) ABSTRACT

A folded metal dipole antenna includes a balun having two sides, the sides having metal contact end portions for electrical connection to a printed circuit board, two radiating elements, each radiating element in coplanar relationship to a corresponding side of the balun, and an antenna support member having a spacer portion placed between the two sides of the balun. The spacer portion is used to separate one radiating element of the dipole antenna from another radiating element of the dipole antenna.

18 Claims, 8 Drawing Sheets

Figure 4(A) -(F) WiFi High Band (5-6GHz) antenna with dipole axis perpendicular to PCB orientation Figure 5(A) -(F) WiFi High Band (5-6GHz) antenna with dipole axis parallel to PCB orientation

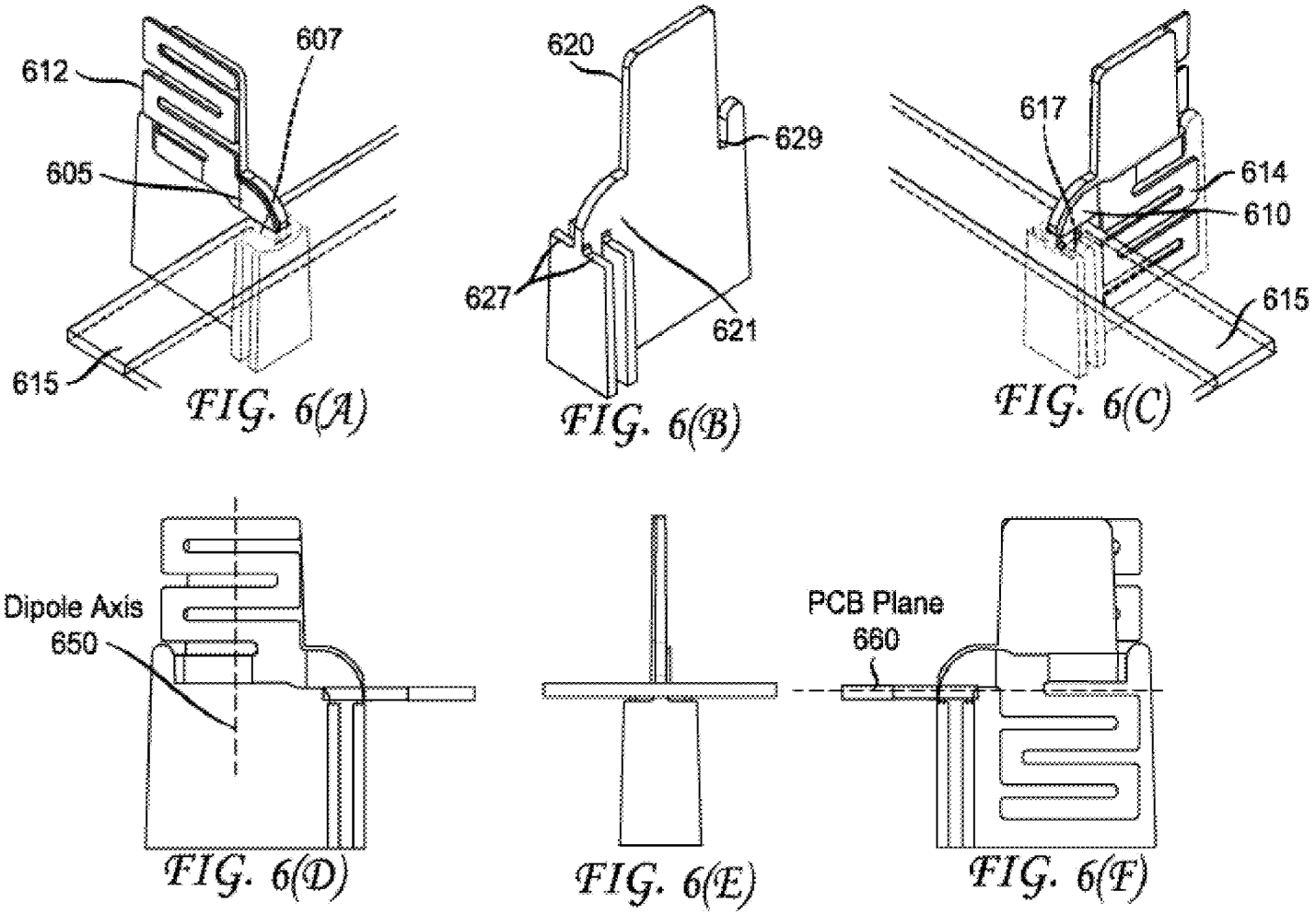
Figure 6(A)-(F) WiFi Low Band (2-4GHz) antenna with dipole axis perpendicular to PCB orientation

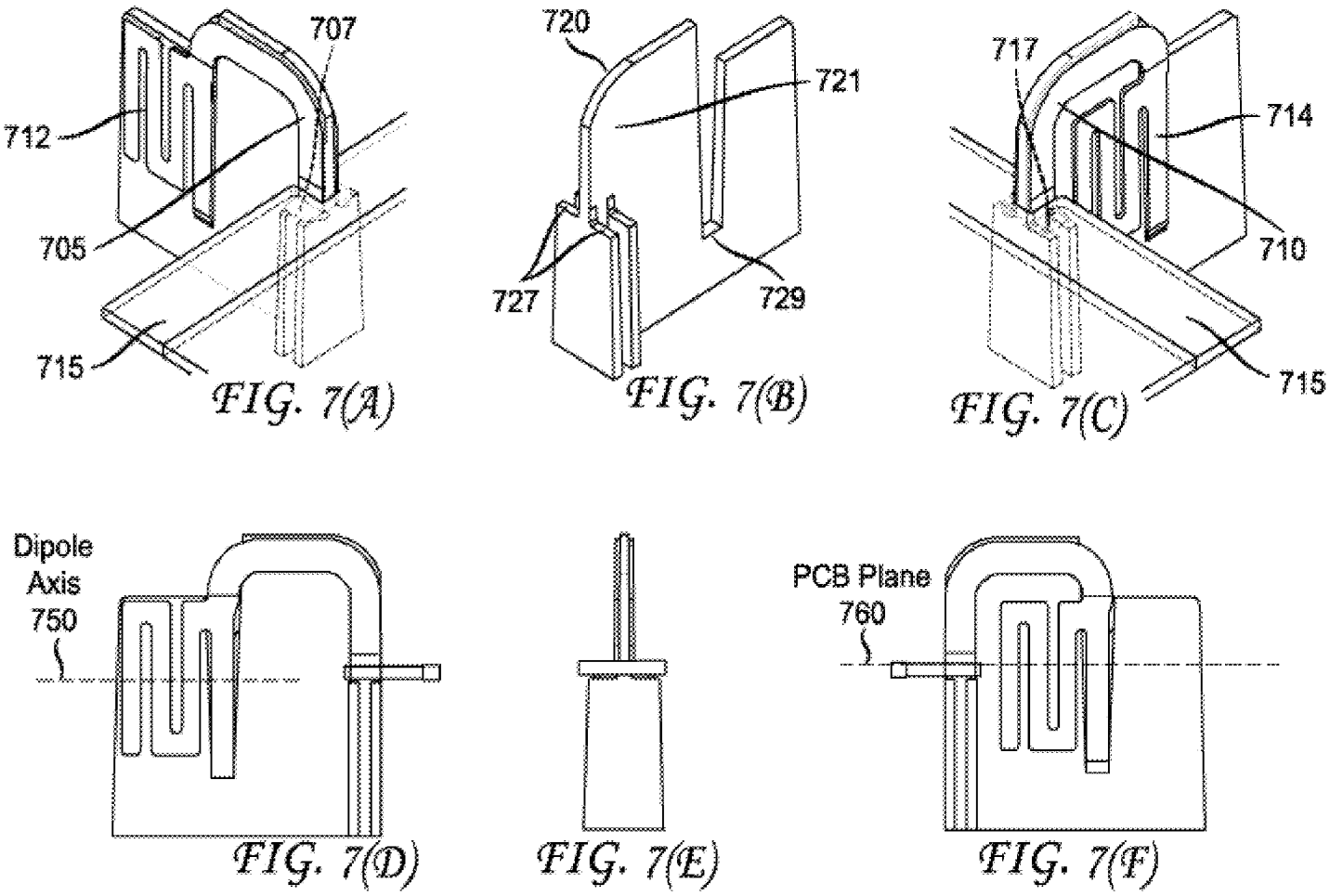
Figure 7(A)-(F) WiFi Low Band (2-4GHz) antenna with dipole axis parallel to PCB orientation

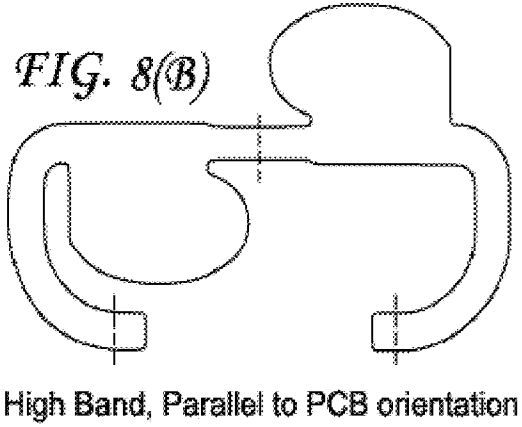
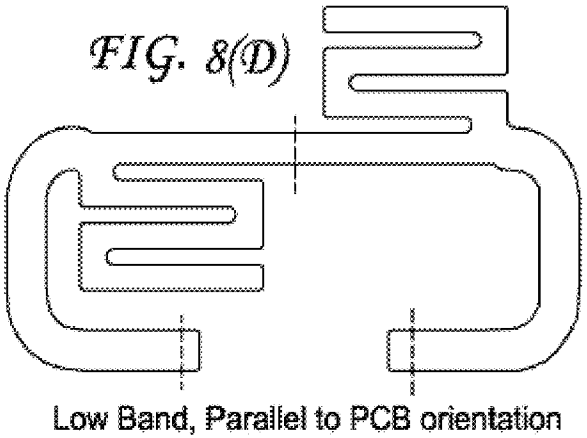
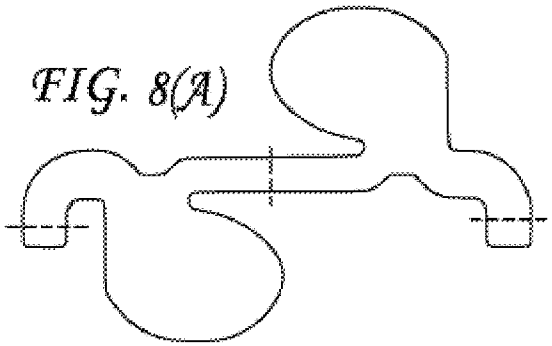
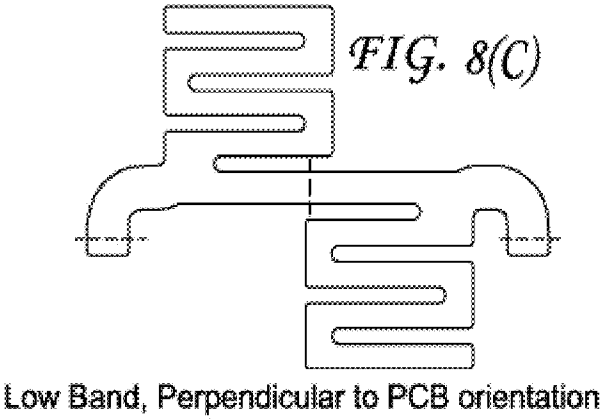
Figure 8(A)-(D) Antennas before folding.

LOW-PROFILE FOLDED METAL ANTENNA

CROSS REFERENCE TO RELATED APPLICATIONS

This application claims the benefit, under 35 U.S.C. § 365 of International Application PCT/US2018/038489, filed Jun. 20, 2018, which was published in accordance with PCT Article 21(2) on Dec. 27, 2018, in English and which further claims the benefit of priority application U.S. 62/522,760, filed on Jun. 21, 2017.

FIELD

The present principles relate to an antenna, specifically, a folded metal antenna to be mounted on a non-conductive surface and connected to a printed circuit board.

BACKGROUND

A folded metal antenna, such as described in PCT application PCT/US17/26597 describes an antenna and mounting apparatus which provides a means to mount a folded metal antenna onto an antenna support structure which also includes a non-metallic spacer for an antenna balun. The radio Frequency (RF) connection to radio circuit on PCB is made via metal contact ends that connect to a printed circuit board (PCB). The complete antenna apparatus is mounted on the non-metallic antenna support structure, but the portion of the folded metal antenna which contained the radiating elements was in a plane perpendicular to the spacer; thus, perpendicular to the balun. Therefore, the antenna elements protruded in plane normal to the spacer. In one instance the protrusion was as much as 14 mm for a Wi-Fi application in a set-top box or gateway product.

This perpendicular element feature with relationship to the balun was desirable if there existed in the physical space of the design a sufficient separation between multiple instantiations of the antenna. The right-angle feature provided a means to fit the antenna and support means in a small space between the PCB and the chassis wall. Thus keeping the industrial design smaller than otherwise would be possible. FIG. 1 depicts an example of an folded metal antenna design 100 according to the design of PCT/US17/26597. The PCB 105 is in electrical contact with metal ends (not shown) of the balun. The sides of the balun are separated by a spacer 115, which is a portion of a plastic antenna support structure holding the element of the antenna, such as antenna element 110. In the design of FIG. 1, there is a small spacing between the antenna and the edge of the chassis. There is also a right angle relationship between the spacer 115 and the radiating element 110.

With the develop of multiple input multiple output (MIMO) technology, the number of antennas required in designs is increasing. Space between antennas is getting smaller. The right-angle protrusion of the radiating element in the previous invention can become a disadvantage in some instances because the right-angle protrusion extends close to the spacer of the adjacent antenna. This is demonstrated in the array of FIG. 2. The array of FIG. 2 is depicted with seven antennas, each separated by 20 mm in this instance. The arrow 202 indicates only approximately 5 mm between portions of the adjacent antenna elements. This small separation can possibly negatively impact antenna performance; specifically, the RF isolation from antenna to antenna. Therefore, there exists a need for a class of folded metal antennas mounted on a spacer which has more isolation when placed in an array.

SUMMARY

This summary is provided to introduce a selection of concepts in a simplified form as a prelude to the more detailed description that is presented later. The summary is not intended to identify key or essential features, nor is it intended to delineate the scope of the claimed subject matter.

In one embodiment, a dipole antenna includes a balun, wherein the balun comprises two sides, the sides having metal contact end portions for electrical connection to a printed circuit board. The dipole antenna includes two radiating elements, each radiating element in coplanar relationship to a corresponding side of the balun, and an antenna support member, having a spacer portion placed between the two sides of the balun, wherein the spacer portion separates one radiating element of the dipole antenna from another radiating element of the dipole antenna.

In other embodiments, the antenna is a folded metal antenna having three locations for folding. The balun can be arranged to orient the dipole axis in any one of perpendicular to the printed wiring board, parallel to the printed wiring board, or in the range from perpendicular to parallel to the printed wiring board. The metal contact end portions connect with conductive pads on a printed circuit board, wherein the printed circuit board is removably connected to the antenna apparatus. The antenna of any of claims 1-4, wherein the antenna apparatus is connected to a printed circuit board absent an RF cable or RF connector.

In one embodiment, an array of antennas includes at least a first antenna and a second antenna. Each antenna including a balun, wherein the balun includes two sides, the sides including metal contact end portions for electrical connection to the printed circuit board. Each antenna including two radiating elements, each radiating element in coplanar relationship to a corresponding side of the balun. Each antenna including a support member, including a spacer portion placed between the two sides of the balun, wherein the spacer portion separates one radiating element from another radiating element.

In other embodiments, the array of antennas includes a radiating element of the first antenna that is arranged to be substantially parallel to a radiating element of the second antenna. The first antenna includes a first dipole axis perpendicular to a printed circuit board orientation and the second antenna includes a second dipole axis parallel to the printed circuit board orientation. The order of the array of antennas is an alternating arrangement of dipole axes that are perpendicular to the printed circuit board orientation and dipole axes that are parallel to the printed circuit board orientation.

In other embodiments, the first antenna includes operation in a first frequency band and the second antenna includes operation in a second frequency band. The order of the array of antennas can be an alternating arrangement of antennas that include Wi-Fi high band antenna and Wi-Fi low band antenna. The Wi-Fi high band antenna can operate at 5 to 6 GHz and the Wi-Fi low band antenna can operate at 2 to 4 GHz.

In other embodiments, the array includes a third antenna, having a third dipole axis perpendicular to the printed circuit board orientation, and a fourth antenna having a fourth dipole axis parallel to the printed circuit board orientation. The third antenna and the fourth antenna can be arranged in linear order on the printed circuit board next to the second antenna. An electronic device may utilize either a single antenna or a plurality of antennas in an array of antennas.

Additional features and advantages will be made apparent from the following detailed description of illustrative embodiments which proceeds with reference to the accompanying figures. The drawings are for purposes of illustrating the concepts of the disclosure and is not necessarily the only possible configuration for illustrating the disclosure. Features of the various drawings may be combined unless otherwise stated.

BRIEF DESCRIPTION OF THE DRAWINGS

The foregoing summary, as well as the following detailed description of illustrative embodiments, is better understood when read in conjunction with the accompanying drawings, which are included by way of example, and not by way of limitation with regard to the present principles. In the drawings, like numbers represent similar elements.

FIG. 3(*b*) is an isometric view of the array of FIG. 3(*a*);

FIG. 4(*b*) depicts the perpendicular axis orientation Wi-Fi high band antenna support structure according to principles of the disclosure;

FIG. 4(*c*) depicts an isometric view of the perpendicular axis orientation Wi-Fi high band lower element antenna design right side according to principles of the disclosure;

FIG. 4(*d*) depicts a left side view of the perpendicular axis orientation Wi-Fi high band upper element antenna design according to principles of the disclosure;

FIG. 4(*e*) depicts an edge on view of the perpendicular axis orientation Wi-Fi high band antenna support structure according to principles of the disclosure;

FIG. 4(*f*) depicts a right side view of the perpendicular axis orientation Wi-Fi high band lower element antenna design according to principles of the disclosure;

FIG. 5(*b*) depicts the parallel axis orientation Wi-Fi high band antenna support structure according to principles of the disclosure;

FIG. 5(*c*) depicts an isometric view of the parallel axis orientation Wi-Fi high band lower element antenna design right side according to principles of the disclosure;

FIG. 5(*d*) depicts a left side view of the parallel axis orientation Wi-Fi high band upper element antenna design according to principles of the disclosure;

FIG. 5(*e*) depicts an edge on view of the parallel axis orientation Wi-Fi high band antenna support structure according to principles of the disclosure;

FIG. 5(*f*) depicts a right side view of the parallel axis orientation Wi-Fi high band lower element antenna design according to principles of the disclosure;

FIG. 6(*a*) depicts an isometric view of the perpendicular axis orientation Wi-Fi low band upper element antenna design left side according to principles of the disclosure;

FIG. 6(*b*) depicts the perpendicular axis orientation Wi-Fi low band antenna support structure according to principles of the disclosure;

FIG. 6(*c*) depicts an isometric view of the perpendicular axis orientation Wi-Fi low band lower element antenna design right side according to principles of the disclosure;

FIG. 6(*d*) depicts a left side view of the perpendicular axis orientation Wi-Fi low band upper element antenna design according to principles of the disclosure;

FIG. 6(*e*) depicts an edge on view of the perpendicular axis orientation Wi-Fi low band antenna support structure according to principles of the disclosure;

FIG. 6(*f*) depicts a right side view of the perpendicular axis orientation Wi-Fi low band lower element antenna design according to principles of the disclosure;

FIG. 7(*a*) depicts an isometric view of the parallel axis orientation Wi-Fi low band upper element antenna design left side according to principles of the disclosure;

FIG. 7(*b*) depicts the parallel axis orientation Wi-Fi low band antenna support structure according to principles of the disclosure;

FIG. 7(*c*) depicts an isometric view of the parallel axis orientation Wi-Fi low band lower element antenna design right side according to principles of the disclosure;

FIG. 7(*d*) depicts a left side view of the parallel axis orientation Wi-Fi low band upper element antenna design according to principles of the disclosure;

FIG. 7(*e*) depicts an edge on view of the parallel axis orientation Wi-Fi low band antenna support structure according to principles of the disclosure;

FIG. 7(*f*) depicts a right side view of the parallel axis orientation Wi-Fi low band lower element antenna design according to principles of the disclosure;

FIG. 8(*a*) depicts and un-folded Wi-Fi high band antenna design according to principles of the disclosure;

FIG. 8(*a*) depicts and un-folded Wi-Fi high band antenna design having perpendicular orientation according to principles of the disclosure;

FIG. 8(*b*) depicts an un-folded Wi-Fi high band antenna design having parallel orientation according to principles of the disclosure;

FIG. 8(*c*) depicts and un-folded Wi-Fi low band antenna design having perpendicular orientation according to principles of the disclosure; and FIG. 8(*d*) depicts an un-folded Wi-Fi low band antenna design having parallel orientation according to principles of the disclosure.

DETAILED DISCUSSION OF THE EMBODIMENTS

In the following description of various illustrative embodiments, reference is made to the accompanying drawings, which form a part thereof, and in which is shown, by way of illustration, how various embodiments may be practiced. It is to be understood that other embodiments may be utilized and structural and functional modification may be made without departing from the scope of the present principles.

The disclosure herein describes a low profile folded metal antenna suitable for use in an array of antennas. In one aspect of the disclosure, the radiating element of the low profile folded metal antenna does not protrude at a right angle from a spacer that separates the balun of a dipole. Instead, the low profile folded metal antenna has dipole elements which remain substantially on the planes of the metal sides of the balun, where each metal side is separated by a spacer. As a result, an array of these antenna designs, can advantageously be mounted at closer antenna to antenna spacings. Accordingly, the RF isolation from antenna to antenna is improved in such an array.

Figure 2:
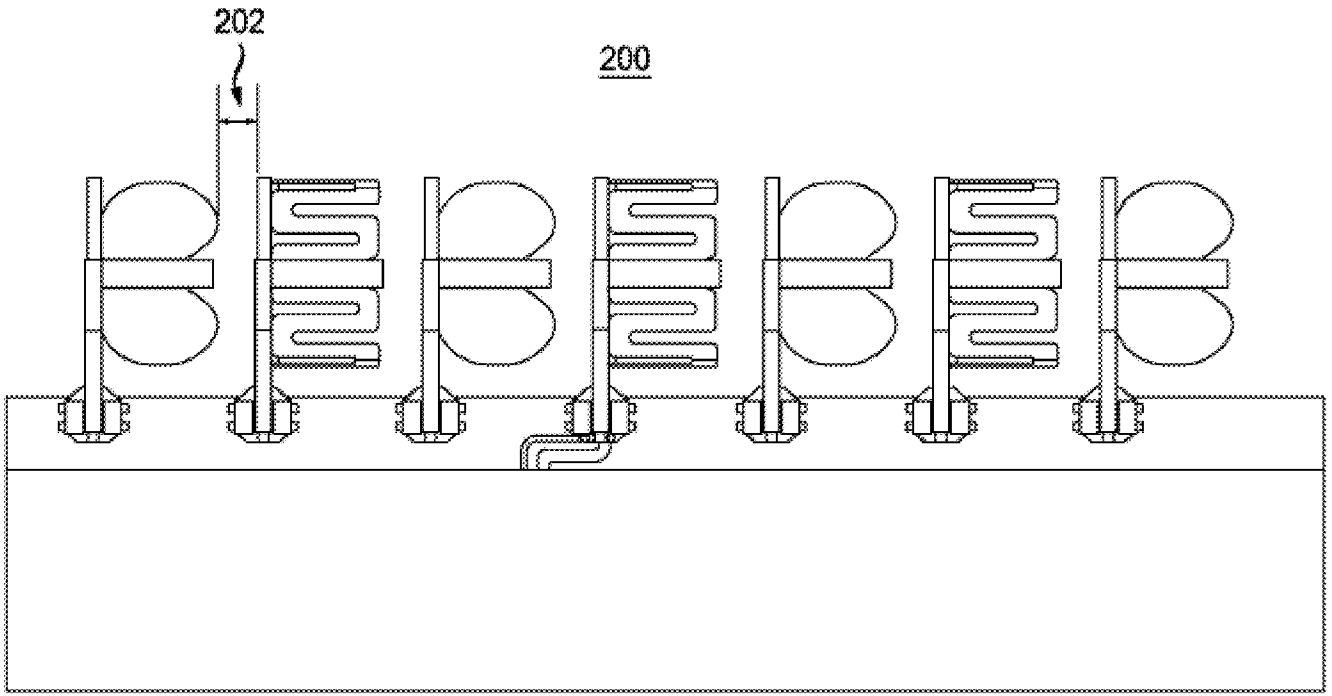
FIG. 2 is an antenna array using the prior design antenna.
Figure 3A:
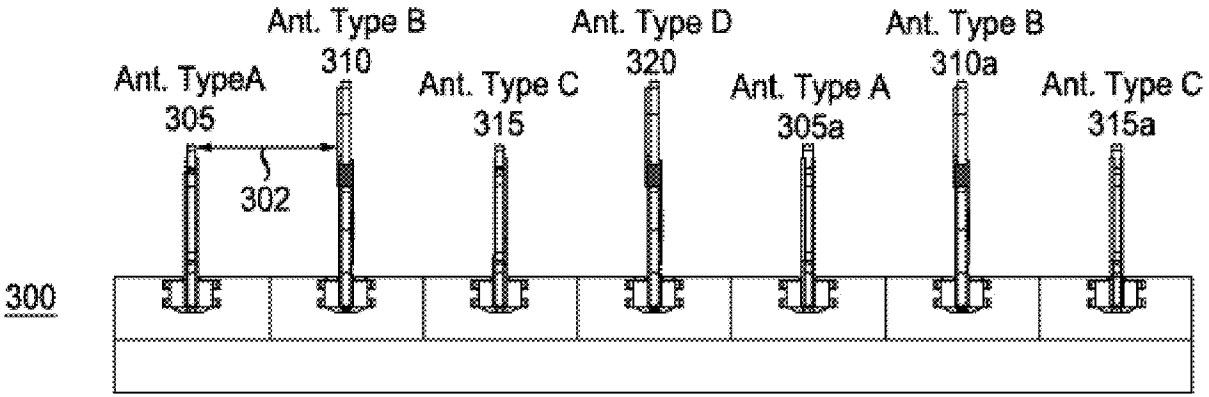
FIG. 3(*a*) is an antenna array using an antenna designs according to principles of the disclosure.
Figure 3B:
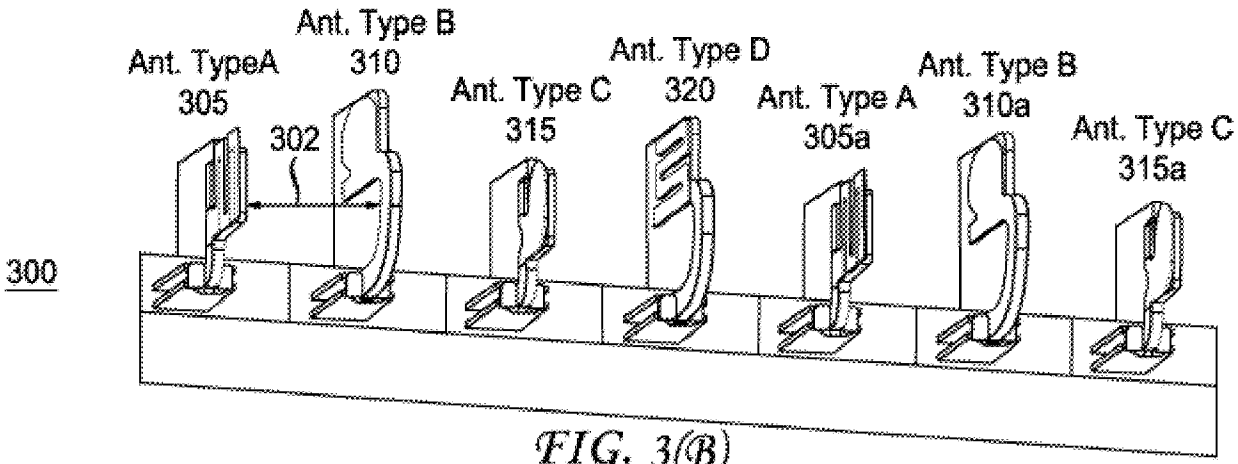
Figure 4C:
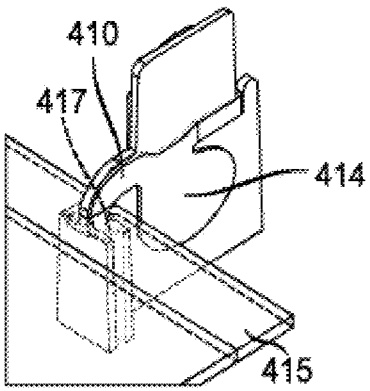
FIG. 4(*a*) depicts an isometric view of the perpendicular axis orientation Wi-Fi high band upper element antenna design left side according to principles of the disclosure.
Figure 4B:
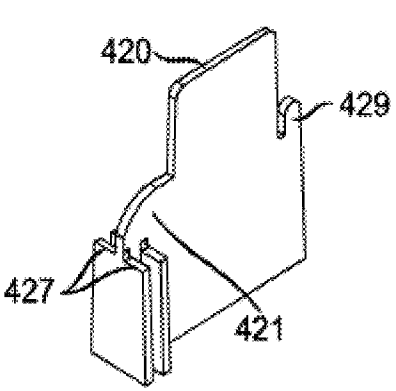
Figure 4A:
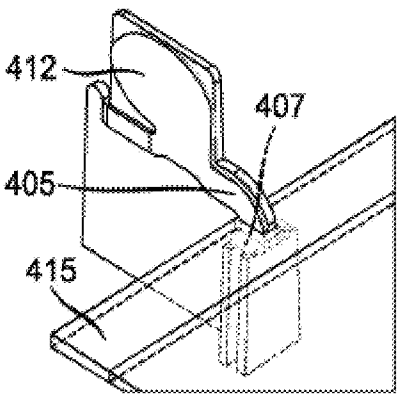
Figure 4F:
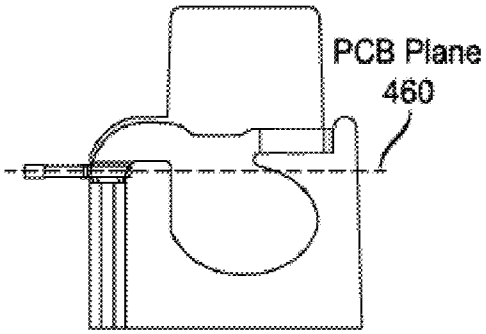
Figure 4E:
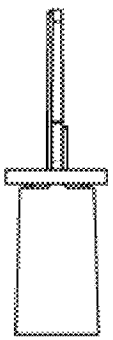
Figure 4D:
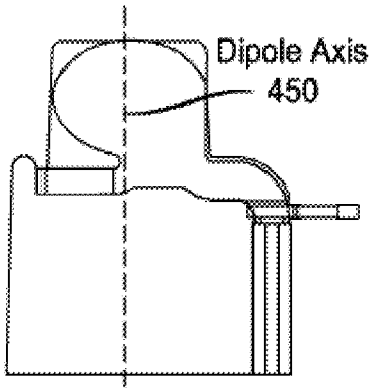
Figure 5A:
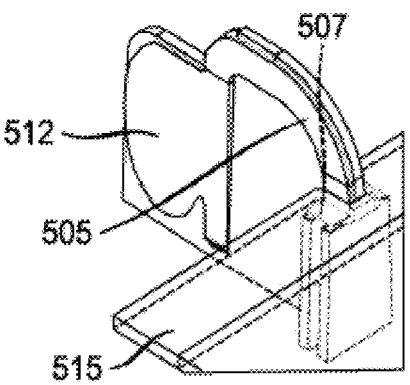
FIG. 5(*a*) depicts an isometric view of the parallel axis orientation Wi-Fi high band upper element antenna design left side according to principles of the disclosure.
Figure 5B:
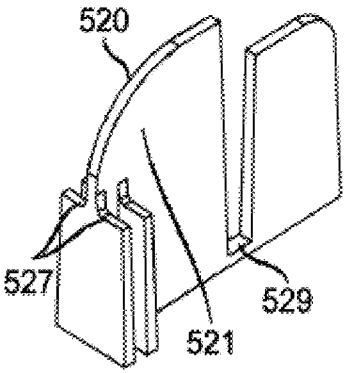
Figure 5C:
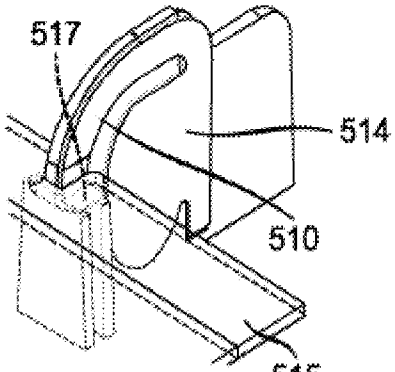
Figure 5D:
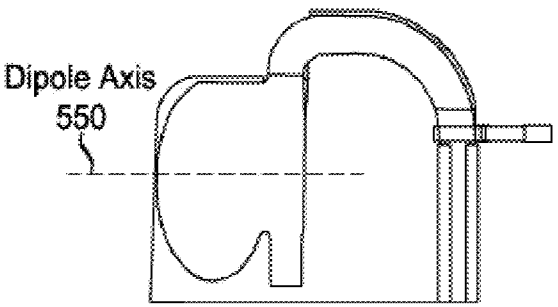
Figure 5E:
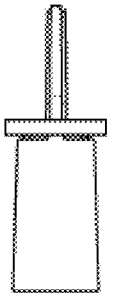
Figure 5F:
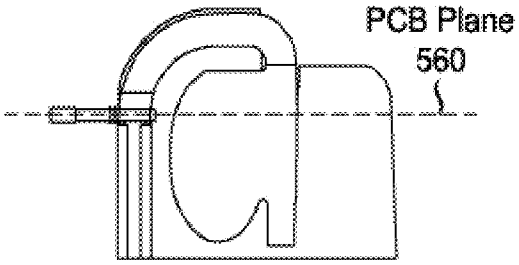

The features of the low profile folded metal antenna described in the disclosure herein represent a new class of antenna that mounts completely on the surface planes of a spacer between the metal balun sides of the folded metal antenna. When multiple instantiations of these antennas are placed along the edge of a PCB, greater physical and RF isolation is realized for a given spacing between antennas. FIGS. 3(*a*) and 3(*b*) represent two views of an antenna array 300. FIG. 3(*a*) is an on-edge view showing the separation, via arrow 302, of the improved separation of the antenna element portions in adjacent antennas compared to the antenna array of FIG. 2 arrow 202. For example, the separation 202 between antenna element portions of FIG. 2 is 5 MM, whereas the separation 302 in FIG. 3(*a*) between antenna elements is 20 MM. The increase in physical separation between antennas in the array of FIG. 3(*a*) indicates greater spatial diversity in the FIG. 3(*a*) configuration compared to previous designs. FIG. 3(*b*) is an isometric view of the antenna array 300 of FIG. 3(*a*). Also shown are the various antenna types. Antenna type A 305 is a Wi-Fi low band antenna have a perpendicular dipole axis with respect to the PCB. Antenna type B 310 is a Wi-Fi high band antenna have a parallel dipole axis with respect to the PCB. Antenna type C 315 is a Wi-Fi high band antenna have a perpendicular dipole axis with respect to the PCB. Antenna type D 320 is a Wi-Fi low band antenna have a parallel dipole axis with respect to the PCB. Antenna 305*a*, 310*a*, and 315*a* are additional instances of antennas 305, 310, and 315 respectively. The antenna types are further described below.

The low-profile antennas described herein are applicable to wide frequency ranges (700 MHz to 10 GHz) and can be used for any radio technology. Multiple orientations can be applied to it. Described below are several examples to illustrate the variations that can be applied to this class of folded metal antenna. In all cases, the radiating element and physical features of the antenna are substantially located on the surface planes of the spacer used to space the sides of the balun of the dipole antenna. For example, the low profile folded metal antenna design can be applied to low band (2.4 GHz) and high band (5-6 GHz) Wi-Fi MIMO technologies.

Figure 1:
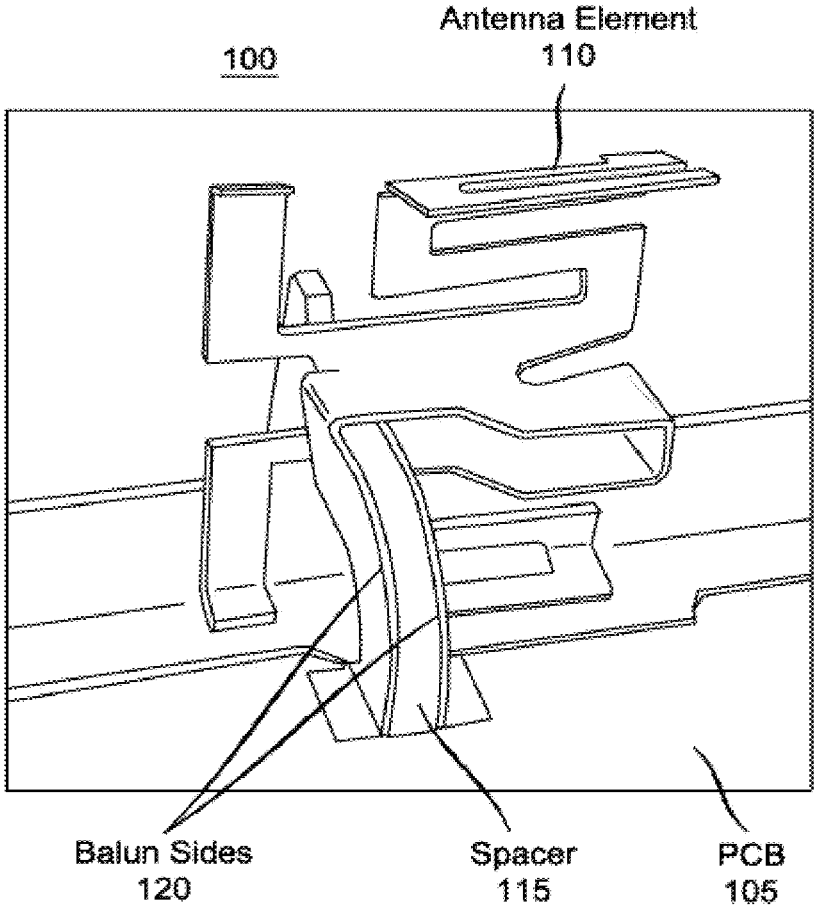
FIG. 1 is a prior design antenna.

A second desirable feature of the new class of low profile folded metal antennas is the simplicity of fabrication. The previous folded metal design antenna of FIG. 1 required at least six folds of the sheet metal to form the three-dimensional antenna that is shown in FIG. 1. The low-profile antenna design described herein requires three folds. Descriptively, there is a 180-degree fold at the center wrap-around point of a stamped metal sheet that forms the antenna. And there is another folding slightly less than 90-degree for each of the two balun ends that make contact with the PCB. Thus, the tooling cost for fabrication is reduced over the previous invention.

FIGS. 4(*a*)-(*e*), FIGS. 5(*a*)-(*e*), FIGS. 6(*a*)-(*e*), and FIGS. 7(*a*)-(*e*) depict folded metal antenna designs. Each share some similar characteristics, but each is designed for differing frequency operation, band coverage, and polarization isolation characteristics with respect to the PCB. These shared characteristics are described hereinbelow. Each antenna of the various above-described figures is a folded metal antenna that, when folded and assembled, forms a dipole antenna. The folded metal antenna structure includes a folded metal balun portion, for example 405, 410 of FIGS. 4(*a*) and 4(*c*) are the two sides of the metal balun. Each side has a metal contact end portion for electrical contact with PCB 415. In FIGS. 4(*a*) and 4(*c*), the metal contact end portions 407 and 417 are shown under the PCB 415 because the PCB fits over the metal contact end portions in order to connect to the PCB 415. The metal contact end portions connect with conductive pads on a printed circuit board. In one feature, there is no need for a permanent connection between the metal contact end portions and the PCB. The advantage is to allow the folded metal antenna to be removably attached to the PCB. Since metal contact ends are used to make connection to the PCB, one feature of the low profile folded metal antenna design is a removable connection between the folded metal antenna and RF drive circuitry on the PCB without (absent) use of an RF cable or an RF connector.

In furtherance of describing common features of the antennas of FIGS. 4-7(*a*) thorough (f), by example, FIG. 4(*b*) depicts the antenna support structure 420 for the folded metal antenna shown in FIGS. 4(*a*) and 4(*c*). The antenna support structure 420 includes portions that act as a spacer 421 to separate the metal balun sides 405, 410 as well as the upper antenna element 412 and lower antenna element 414. The spacer portion 421 has a thickness which is used to separate one radiating element of the dipole antenna from another radiating element of the dipole antenna. Antenna support structure also includes floor portions 427 that support the metal contact ends 407, 417 of the balun sides 405, 410 respectively. The floor portions can be one solid piece for each metal contact end or may have a space as shown in FIG. 4(*b*). Antenna support structure may also include a notch 429 to provide additional physical support to the folded metal antenna.

FIG. 4(*a*) illustrates an example of the upper radiating element 412. The lower radiating element 414 of the dipole antenna is shown in FIG. 4(*c*). The antenna support structure 420 separates the upper radiating element 412 from the lower radiating element 414 such that both are in substantially parallel planes. That is, the upper radiating element and the lower radiating element have a parallel relationship to each other; each are in planes substantially parallel to the other. In another aspect, the upper radiating element 412 of FIG. 4(*a*) is coplanar with the balun side 405 which feed the element 412. In a similar manner, the lower radiating element 414 is coplanar with the balun side 410 which feeds the lower element 414. Thus, the two radiating elements 412, 414, are in coplanar relationship to the corresponding metal sides 405, 410 of the metal balun each corresponding metal balun side and radiating element are coplanar. Also, the upper radiating element 412 and the lower radiating element 414 have a substantially parallel relationship to each other. Another advantage of the antenna configuration shown in FIGS. 4(*a*) and 4(*c*) is that the PCB 415 can be tested without antennas mounted on the PC board. This feature allows for more economical and easier test fixture configurations because fragile antennas need not be part of an assembly for PCB test purposes.

Thus, some common features of the folded metal antennas of FIGS. 4(*a*)-(*e*) through FIG. 7 (*a*)-(*e*) include a folded metal balun, wherein the metal balun includes two metal sides, the metal sides having metal contact end portions for electrical connection to a printed circuit board. Also included in each dipole antenna are two radiating elements, each radiating element in coplanar relationship to a corresponding metal side of the metal balun. An antenna support member for each antenna has a spacer portion placed between the two metal sides of the metal balun. The spacer portion is also used to separate one radiating element of the dipole antenna from another radiating element of the dipole antenna.

The four low profile antenna types are now described. FIG. 4(*a*) depicts an isometric view of the Wi-Fi high band (5-6 GHz) upper element antenna design showing left side. The FIG. 4(*a*) antenna design has a perpendicular axis orientation when compared to the ground plane of the PCB. The dipole axis 450 is defined as the axis along the length of the dipole elements as shown in FIG. 4(*d*). The PCB has a ground plane 460 as shown in FIG. 4(*f*). The antenna dipole axis 450 is perpendicular to the PCB ground plane 460. Thus, the antenna shown in FIGS. 4(*a*) through 4(*f*) has a perpendicular axis when compared to the PCB ground plane. The antenna of FIGS. 4(*a*) through 4(*f*) is a Type C antenna as in FIG. 3(*a*).

FIG. 4(*b*) illustrates the mechanical configuration of the antenna support structure for the FIG. 4(*a*) Wi-Fi high band antenna having perpendicular dipole axis orientation with respect to the PCB ground plane. FIG. 4(*c*) depicts an isometric view showing the lower element of the Wi-Fi high band antenna having perpendicular dipole axis orientation. FIG. 4(*d*) depicts a left side view of the Wi-Fi high band antenna design having perpendicular axis orientation showing the band upper element. FIG. 4(*e*) depicts an edge on view of the Wi-Fi high band antenna support structure. FIG. 4(*f*) depicts a right side view of the Wi-Fi high band antenna design having perpendicular axis orientation showing the lower element.

FIGS. 5(*a*)-(*f*) illustrate a Wi-Fi High Band (5-6 GHz) antenna with dipole axis parallel to PCB ground plane orientation. FIG. 5(*a*) depicts an isometric view of the Wi-Fi high band upper element antenna design with the left side shown. FIG. 5(*a*) depicts the upper element 512, the balun side 505, and the metal contact end 507 that makes electrical contact with the PCB 515. FIG. 5(*b*) depicts Wi-Fi high band antenna support structure 520 including the spacer portion 521, the floor portions 527, and the notch 529 that provides mechanical support for the folded metal antenna. FIG. 5(*c*) depicts an isometric view of the Wi-Fi high band lower element antenna design showing the right side. FIG. 5(*c*) depicts the lower antenna element 514, the balun side 510, and the metal contact end 517 that makes electrical contact with the PCB 515. FIG. 5(*d*) depicts a left side view the Wi-Fi high band upper antenna element design showing the orientation of the dipole axis 550. The antenna dipole 550 is parallel to the PCB ground plane 560. Thus, the antenna shown in FIGS. 5(*a*) through 5(*f*) has a parallel axis when compared to the PCB ground plane. FIG. 5(*e*) depicts an edge on view of the Wi-Fi high band antenna support structure. FIG. 5(*f*) depicts a right side view of the Wi-Fi high band lower element antenna design that has a parallel dipole axis orientation with respect to the ground plane. The antenna of FIGS. 5(*a*) through 5(*f*) is a Type B antenna as in FIG. 3(*a*).

FIGS. 6(*a*)-(*f*) illustrate a Wi-Fi Low Band (2-4 GHz) antenna with dipole axis perpendicular to PCB ground plane orientation. FIG. 6(*a*) depicts an isometric view of the Wi-Fi low band upper element antenna design with the left side shown. FIG. 6(*a*) depicts the upper element 612, the balun side 605, and the metal contact end 607 that makes electrical contact with the PCB 615. FIG. 6(*b*) depicts Wi-Fi low band antenna support structure 620 including the spacer portion 621, the floor portions 627, and the notch 629 that provides mechanical support for the folded metal antenna. FIG. 6(*c*) depicts an isometric view of the Wi-Fi low band lower element antenna design showing the right side. FIG. 6(*c*) depicts the lower antenna element 614, the balun side 610, and the metal contact end 617 that makes electrical contact with the PCB 615. FIG. 6(*d*) depicts a left side view the Wi-Fi low band upper antenna element design showing the orientation of the dipole axis 650. The antenna dipole 650 is perpendicular to the PCB ground plane 660. Thus, the antenna shown in FIGS. 6(*a*) through 6(*f*) has a perpendicular axis when compared to the PCB ground plane. FIG. 6(*e*) depicts an edge on view of the Wi-Fi low band antenna support structure. FIG. 6(*f*) depicts a right side view of the Wi-Fi low band lower element antenna design that has a perpendicular dipole axis orientation with respect to the ground plane. The antenna of FIGS. 6(*a*) through 6(*f*) is a Type A antenna as in FIG. 3(*a*).

FIGS. 7(*a*)-(*f*) illustrate a Wi-Fi Low Band (2-4 GHz) antenna with dipole axis parallel to PCB ground plane orientation. FIG. 7(*a*) depicts an isometric view of the Wi-Fi low band upper element antenna design with the left side shown. FIG. 7(*a*) depicts the upper element 712, the balun side 705, and the metal contact end 707 that makes electrical contact with the PCB 715. FIG. 7(*b*) depicts Wi-Fi low band antenna support structure 720 including the spacer portion 721, the floor portions 727, and the notch 729 that provides mechanical support for the folded metal antenna. FIG. 7(*c*) depicts an isometric view of the Wi-Fi low band lower element antenna design showing the right side. FIG. 7(*c*) depicts the lower antenna element 714, the balun side 710, and the metal contact end 717 that makes electrical contact with the PCB 715. FIG. 7(*d*) depicts a left side view the Wi-Fi low band upper antenna element design showing the orientation of the dipole axis 750. The antenna dipole 750 is parallel to the PCB ground plane 760. Thus, the antenna shown in FIGS. 7(*a*) through 7(*f*) has a parallel axis when compared to the PCB ground plane. FIG. 7(*e*) depicts an edge on view of the Wi-Fi low band antenna support structure. FIG. 7(*f*) depicts a right side view of the Wi-Fi low band lower element antenna design that has a parallel dipole axis orientation with respect to the ground plane. The antenna of FIGS. 7(*a*) through 7(*f*) is a Type D antenna as in FIG. 3(*a*).

Referring to FIG. 3(*a*), in one embodiment, the elements of one antenna are substantially parallel to elements of the adjacent antenna. It is noted in the array of FIG. 3, one possible way to increase RF isolation between antennas is to have adjacent antennas be of different polarities or orientations. In FIGS. 3(*a*) and 3(*b*), a Type A antenna, of perpendicular orientation with respect to the ground plane, can be placed next to an antenna of parallel orientation with respect to the ground plane, such as antenna Type B. One principle of isolation is a 90-degree (orthogonal) difference between adjacent antennas. If each of the two adjacent antennas maintained a 90-degree orthogonality between them, then any angle of the orientation with respect to the ground plane will still produce good isolation between adjacent antennas. Thus, the FIG. 3 antenna array exhibits polarity diversity between adjacent antennas. Such polarity diversity allows for advantageous compatibility by arranging adjacent antennas to have polarities 90 degrees apart.

A variation of the antenna configurations of FIGS. 4(*a*)-(*e*) though FIG. 7(*a*)-(*e*) includes changing the dipole axis with respect to the ground plane of the PCB. For example, if the dipole axis of a first antenna was 45 degrees, and a dipole axis of an adjacent antenna was −45 degrees, then a difference between the two antennas would remain at 90 degrees. Thus, one variation of the designs of FIGS. 4(*a*)-(*e*) though FIG. 7(*a*)-(*e*) includes adjusting the length and curvature of the balun to accommodate angles other than perpendicular or parallel to the PCB ground plane. For example, angles of 0 to +90 degrees or 0 to −90 degrees are contemplated to be within the scope of the disclosure. This 45-degree variation is another separate instance of polarity diversity for an array of antennas.

Returning to the array of FIG. 3, the array can also be viewed as having frequency diversity between some adjacent antennas. For example, the Type A antenna 305 is a low band (2-4 GHz) antenna. The Type A antenna is located next to a Type B antenna 310 which is a high band (5-6 GHz) antenna. Thus, there is frequency diversity between Type A and Type B adjacent antennas. The Type D antenna 320 is a low band (5-6 G Hz) antenna located next to a Type C high band (5-6 GHz) antenna. Thus, there is frequency diversity between Type C and Type D adjacent antennas.

The example antenna array of FIG. 3 utilizes both frequency diversity and polarity diversity. There is frequency diversity between adjacent antenna Types A and B and between Types C and D. There is polarity diversity between antenna Types A and B, between antenna Types B and C, and between Types C and D. As is well appreciated, other combinations of frequency diversity and polarity diversity are possible in an antenna array using the novel antenna designs of FIGS. 4(*a*), 5(*a*), 6(*a*), and 7(*a*). The example array of FIG. 3 is only one example construction of an array of antennas that uses both frequency and polarity diversity for self-compatibility.

FIG. 8 shows the antennas before they have been folded. These unfolded or pre-folded metal antennas relate to the examples of the antennas of FIGS. 4(*a*), 5(*a*), 6(*a*), 7(*a*) respectively. FIG. 8(*a*) represents an unfolded metal stamping of a high band perpendicular orientation antenna like that of FIG. 4(*a*). FIG. 8(*b*) represents an unfolded metal stamping of a high band parallel orientation antenna like that of FIG. 5(*a*). FIG. 8(*c*) represents an unfolded metal stamping of a low band perpendicular orientation antenna like that of FIG. 6(*a*). FIG. 8(*d*) represents an unfolded metal stamping of a low band parallel orientation antenna like that of FIG. 7(*a*). The dotted lines in FIGS. 8(*a*) through 8(*d*) indicate the fold locations. It is noted that only three fold locations in each antenna type are needed to form the antenna before insertion onto the respective support structure.

The embodiments of dipole antennas depicted in FIGS. 4(*a*) through 4(*f*), 5(*a*) through 5(*f*), 6(*a*) through 6(*f*), and 7(*a*) through 7(*f*) can be used singularly or in combination in an electronic device. As such, the antenna or multiple antennas form part of the transmission and/or reception system of a radio for the electronic device. Additionally, a combination of two or more of the above antennas can form a part of an antenna array. One example embodiment is shown in FIGS. 3(*a*) and 3(*b*). an electronic device including one or more of the dipole antennas or an example array may include, but is not limited to, a set top box, a gateway, a modem, a device used for WiFi radio frequency interactions, and the like. Any and all of the embodiments depicted and/or described in the above disclosure are combinable and useable together unless otherwise specifically stated. Thus, single antennas may be used or may be combined with any or all other described antenna designs as a combination. Additionally, any combination of polarity diversity, frequency diversity, spatial diversity, or no diversity is contemplated in this disclosure.

The invention claimed is:

1. An antenna comprising:

a balun, wherein the balun comprises two sides, the sides having metal contact end portions for electrical connection to a printed circuit board;

two radiating elements, each radiating element in coplanar relationship to a corresponding side of the balun; and an antenna support member, having a spacer portion placed between the two sides of the balun, wherein the spacer portion separates one radiating element of the dipole antenna from another radiating element of the dipole antenna, wherein the antenna is folded metal antenna having three locations for folding.

2. The antenna of claim 1, wherein the balun can be arranged to orient the dipole axis in any one of perpendicular to the printed circuit board, parallel to the printed circuit board, or in the range from perpendicular to parallel to the printed circuit board.

3. The antenna of claim 1, wherein the metal contact end portions connect with conductive pads on a printed circuit board, wherein the printed circuit board is removably connected to the antenna.

4. The antenna of claim 1, wherein the antenna is connected to a printed circuit board absent an RF cable or RF connector.

5. An array of antennas, the array comprising:

a first antenna and a second antenna, each antenna comprising:

a balun, wherein the balun comprises two sides, the sides including metal contact end portions for electrical connection to the printed circuit board, and two radiating elements, each radiating element in coplanar relationship to a corresponding side of the balun; and an antenna support member, having a spacer portion placed between the two sides of the balun, wherein the spacer portion separates one radiating element from another radiating element, wherein at least one of the first antenna and the second antenna is a folded metal antenna having three locations for folding.

6. The array of claim 5, wherein a radiating element of the first antenna is arranged to be substantially parallel to a radiating element of the second antenna.

7. The array of claim 5, wherein the first antenna includes a first dipole axis perpendicular to a printed circuit board orientation and the second antenna includes a second dipole axis parallel to the printed circuit board orientation.

8. The array of claim 5, wherein the order of the array of antennas is an alternating arrangement of dipole axes that are perpendicular to the printed circuit board orientation and dipole axes that are parallel to the printed circuit board orientation.

9. The array of claim 5, wherein the first antenna includes operation in a first frequency band and the second antenna includes operation in a second frequency band.

10. The array of claim 5, wherein the order of the array of antennas is an alternating arrangement of antennas that include Wi-Fi high band antenna and Wi-Fi low band antenna.

11. The array of claim 10, wherein the Wi-Fi high band antenna operates at 5 to 6 GHz and the Wi-Fi low band antenna operates at 2 to 4 GHz.

12. The array of any claim 5, further comprising:

a third antenna, having a third dipole axis perpendicular to the printed circuit board orientation; and a fourth antenna having a fourth dipole axis parallel to the printed circuit board orientation.

13. The array of claim 12, wherein the third antenna and the fourth antenna are arranged in linear order on the printed circuit board next to the second antenna.

14. An electronic device, comprising:

at least one antenna, the at least one antenna further comprising:

a balun, wherein the balun comprises two sides, the sides including metal contact end portions for electrical connection to the printed circuit board, and two radiating elements, each radiating element in coplanar relationship to a corresponding side of the balun; and an antenna support member, having a spacer portion placed between the two sides of the balun, wherein the spacer portion separates one radiating element from another radiating element, wherein the at least one antenna is a folded metal antenna having three locations for folding.

15. The electronic device of claim 14, wherein the balun can be arranged to orient the dipole axis in any one of perpendicular to the printed wiring board, parallel to the printed wiring board, or in the range from perpendicular to parallel to the printed wiring board.

16. The electronic device of claim, 14, wherein the metal contact end portions connect with conductive pads on a printed circuit board, wherein the printed circuit board is removably connected to the electronic device.

17. The electronic device of claim 14, wherein the at least two antennas is two antennas and wherein a first antenna includes operation in a first frequency band and a second antenna includes operation in a second frequency band.

18. The electronic device of claim 17, wherein the first antenna operates at 5 to 6 GHz and the second antenna operates at 2 to 4 GHz.

* * * * *